US009088097B2

(12) United States Patent
Kim et al.

(10) Patent No.: US 9,088,097 B2
(45) Date of Patent: Jul. 21, 2015

(54) MAGNETIC CONNECTOR MODULE HAVING POWER SUPPLY BLOCKING CIRCUIT

(71) Applicant: SPS CO., LTD., Daejeon (KR)

(72) Inventors: Hyun Jun Kim, Daejeon (KR); Dae-Young Youn, Seoul (KR); Hyun-Soo Park, Daejeon (KR)

(73) Assignee: SPS, Inc., Daejon (KR)

( * ) Notice: Subject to any disclaimer, the term of this patent is extended or adjusted under 35 U.S.C. 154(b) by 142 days.

(21) Appl. No.: 13/898,503

(22) Filed: May 21, 2013

(65) Prior Publication Data

US 2014/0235075 A1 Aug. 21, 2014

(30) Foreign Application Priority Data

Feb. 20, 2013 (KR) ..... 10-2013-0017834

(51) Int. Cl.

| | |
|---|---|
| ***H01R 13/60*** | (2006.01) |
| ***H01R 13/62*** | (2006.01) |
| ***H01R 13/703*** | (2006.01) |
| ***H01R 24/38*** | (2011.01) |
| ***H01R 31/08*** | (2006.01) |
| ***H01R 11/30*** | (2006.01) |
| *H01R 12/59* | (2011.01) |
| *H01R 13/24* | (2006.01) |
| *H01R 13/641* | (2006.01) |

(52) U.S. Cl.

CPC ..... *H01R 13/6205* (2013.01); *H01R 11/30* (2013.01); *H01R 13/7031* (2013.01); *H01R 24/38* (2013.01); *H01R 31/08* (2013.01); *H01R 12/59* (2013.01); *H01R 13/24* (2013.01); *H01R 13/641* (2013.01)

(58) Field of Classification Search

USPC ..... 439/21, 39, 188, 489

See application file for complete search history.

(56) References Cited

U.S. PATENT DOCUMENTS

| | | | | |
|---|---|---|---|---|
| 3,270,267 | A * | 8/1966 | Nolte, Jr. | 320/138 |
| 5,037,322 | A * | 8/1991 | Adams et al. | 439/357 |
| 6,348,035 | B1 * | 2/2002 | Takami | 600/132 |
| 7,183,508 | B2 * | 2/2007 | Kasai | |

(Continued)

FOREIGN PATENT DOCUMENTS

| | | | |
|---|---|---|---|
| JP | 2010-119273 | A | 5/2010 |
| KR | 10-2004-0078968 | A | 9/2004 |

(Continued)

*Primary Examiner* — Neil Abrams

(74) *Attorney, Agent, or Firm* — Oppedahl Patent Law Firm LLC

(57) ABSTRACT

Provided is a magnetic connector module including: a pattern electrode part module; and a pin terminal part module, wherein the pattern electrode part module includes pattern electrodes having a concentric circle shape, pattern electrode part magnets, and a pattern electrode part connector, wherein the pin terminal part module includes a plurality of pin terminals, pin terminal part magnets, and a pin terminal part connector wherein the plurality of pin terminals include a power terminal VCC, a ground power terminal GND, and a signal terminal S, wherein an electrode contacting the ground power terminal GND and an electrode contacting the signal terminal S among the pattern electrodes are electrically short-circuited, and wherein the pin terminal part module includes the power supply blocking circuit allowing power supply to the power terminal VCC only in a state in which the ground power terminal GND and the signal terminal S are electrically short-circuited.

10 Claims, 6 Drawing Sheets

(56) References Cited

U.S. PATENT DOCUMENTS

| | | | | |
|---|---|---|---|---|
| 7,311,526 | B2 * | 12/2007 | Rohrbach et al. | 439/39 |
| 7,336,978 | B2 * | 2/2008 | Kim | 455/574 |
| 7,673,092 | B2 * | 3/2010 | Zhao et al. | 710/313 |
| 7,909,650 | B2 * | 3/2011 | Matsunaga | 439/630 |
| 8,755,851 | B2 * | 6/2014 | Kim et al. | 455/575.1 |
| 8,894,419 | B1 * | 11/2014 | Buelow | 439/39 |
| 2012/0206090 | A1 * | 8/2012 | Hyun-Jun et al. | 320/107 |
| 2012/0295451 | A1 * | 11/2012 | Hyun-Jun et al. | 439/39 |
| 2013/0162222 | A1 * | 6/2013 | Ke et al. | 320/162 |
| 2014/0235075 | A1 * | 8/2014 | Kim et al. | 439/39 |

FOREIGN PATENT DOCUMENTS

| | | | |
|---|---|---|---|
| KR | 20-2011-0010040 | U | 10/2011 |
| KR | 10-1204510 | B1 | 11/2012 |

* cited by examiner

MAGNETIC CONNECTOR MODULE HAVING POWER SUPPLY BLOCKING CIRCUIT

CROSS-REFERENCE TO RELATED APPLICATIONS

This application claims priority under 35 U.S.C. §119 to Korean Patent Application No. 10-2013-0017834, filed on Feb. 20, 2013, in the Korean Intellectual Property Office, the disclosure of which is incorporated herein by reference in its entirety.

TECHNICAL FIELD

The following disclosure relates to a magnetic connector module having a power supply blocking circuit, and more particularly, to a magnetic connector module having a power supply blocking circuit so as to supply power to an electronic device only when an electrode of a pattern electrode part and a pin terminal of a pin terminal part accurately contact each other.

BACKGROUND

Generally, a scheme of using a female connector and a male connector in supplying direct current (DC) power to various electrical/electronic devices (hereinafter, referred to as an "electronic device") has been mainly used. However, in this scheme, damage to the connectors may be generated in a process of connecting the female connector and the male connector to each other, and several inconveniences such as a process of searching for the female connector installed in the electronic device and then vertically inserting or drawing the male connector into or from the female connector may be present.

In order to solve these inconveniences, a technology of using a magnetic connector was developed a long time ago and has been disclosed in Japanese Patent Laid-Open Publication No. 63-274070 published on Nov. 11, 1988 and entitled "Connecting Apparatus", US Patent Laid-Open Publication No. 2010-0080563 published on Apr. 1, 2010 and entitled "Magnetic Connector with Optical Signal Path", US Patent Laid-Open Publication No 2012-0021619 published on Jan., 26, 2012 and entitled "Programmable Magnetic Connectors", Korean Patent Registration No. 1116159 registered on Feb. 7, 2012 and entitled "Terminal Connection Module and Terminal Connection Apparatus Having the Same", and the like.

However, this charging apparatus has a problem that it is impossible to freely detach and rotate the electronic device at any angle. In order to solve this problem, Korean Patent Registration No. 1204510 registered on Nov. 19, 2012 and entitled "Charging Apparatus of Mobile Terminal" has disclosed a charging apparatus including a magnetic connector for freely detaching and rotating an electronic device at any angle.

However, in the magnetic connectors disclosed as described above, since a state in which a connection is erroneous before the connection is stabilized when the magnetic connector is connected may instantaneously occur, damage or a malfunction of the device may occur.

Although a circuit restricting a current when an over-current flows has also been installed in an existing charging apparatus, it is not effective in the case in which the state in which the connection is erroneous before the connection is stabilized when the magnetic connector is connected instantaneously occurs

SUMMARY

An embodiment of the present invention is directed to providing a magnetic connector module capable of preventing damage or a malfunction of a device by instantaneously restricting power supply even though a state in which a connection is erroneous before the connection is stabilized when a magnetic connector is connected instantaneously occurs.

In one general aspect, a magnetic connector module including a power supply blocking circuit, includes: a pattern electrode part module; and a pin terminal part module, wherein the pattern electrode part module includes pattern electrodes having a concentric circle shape, pattern electrode part magnets, and a pattern electrode part connector, wherein the pin terminal part module includes a plurality of pin terminals, pin terminal part magnets, and a pin terminal part connector, wherein the pattern electrode part magnets and the pin terminal part magnets are magnetically coupled to each other to allow the pattern electrodes and the plurality of pin terminals to contact each other, wherein the plurality of pin terminals include a power terminal $V_{CC}$, a ground power terminal GND, and a signal terminal S, wherein an electrode contacting the ground power terminal GND and an electrode contacting the signal terminal S among the pattern electrodes are electrically short-circuited, and wherein the pin terminal part module includes the power supply blocking circuit allowing power supply to the power terminal VCC only in a state in which the ground power terminal GND and the signal terminal S are electrically short-circuited.

The plurality of pin terminals may further include a data terminal D+ and a data terminal D−.

The pin terminal part module may further include a circuit stopping data outputs to the data terminal D+ and the data terminal D− in the case in which a voltage of the data terminal D+ or the data terminal D− is a predetermined reference voltage or more.

The pin terminal part module may further include a circuit stopping a data output to the data terminal D+ in the case in which a voltage of the data terminal D+ is a predetermined reference voltage or more and stopping a data output to the data terminal D− in the case in which a voltage of the data terminal D− is a predetermined reference voltage or more.

The electrode contacting the ground power terminal GND and the electrode contacting the signal terminal S among the pattern electrodes may be formed integrally with each other and have a ring shape.

The pin terminal may have a shape in which a portion of a leaf spring embedded in the pin terminal part module is protruded through a hole.

The pin terminal may have a shape in which a portion of a linear spring embedded in the pin terminal part module is protruded through a hole.

The pattern electrode part magnet may be embedded inside the pattern electrode, and the pin terminal part magnet may be embedded inside the pin terminal.

The pattern electrode part magnets may be disposed at intervals of the same angle at the same distance from the center of the pattern electrode in the vicinity of the pattern electrode, and the pin terminal part magnets may be disposed at intervals of the same angle at the same distance from the center of the pin terminal in the vicinity of the pin terminal.

The pattern electrode part magnets may include a first magnet embedded inside the pattern electrode and third magnets disposed at intervals of the same angle at the same distance from the center of the pattern electrode in the vicinity of the pattern electrode, the pin terminal part magnets may include a second magnet embedded inside the pin terminal and fourth magnets disposed at intervals of the same angle at the same distance from the center of the pin terminal in the vicinity of the pin terminal, and the first magnet may be magnetically coupled to the second magnet and the third magnets may be magnetically coupled to the fourth magnets, respectively, thereby electrically connecting the pattern electrodes and the plurality of pin terminals to each other, respectively.

The pin terminal part connector may be a universal serial bus (USB) connector.

In another general aspect, a magnetic connector module including a power supply blocking circuit, includes: a pattern electrode part module; and a pin terminal part module, wherein the pattern electrode part module includes pattern electrodes having a concentric circle shape, pattern electrode part magnets, and a pattern electrode part connector, wherein the pin terminal part module includes a plurality of pin terminals, pin terminal part magnets, and a pin terminal part connector, wherein the pattern electrode part magnets and the pin terminal part magnets are magnetically coupled to each other to allow the pattern electrodes and the plurality of pin terminals to contact each other, wherein the plurality of pin terminals include a power terminal VCC, a ground power terminal GND, and a signal terminal S, and wherein the pin terminal part module includes the power supply blocking circuit allowing power supply to the power terminal VCC only when the ground power terminal GND and the signal terminal S accurately contact electrodes corresponding thereto.

DETAILED DESCRIPTION OF EMBODIMENTS

Hereinafter, a magnetic connector module including a power supply blocking circuit according to an exemplary embodiment of the present invention will be described in more detail with reference to the accompanying drawings.

Figure 1:
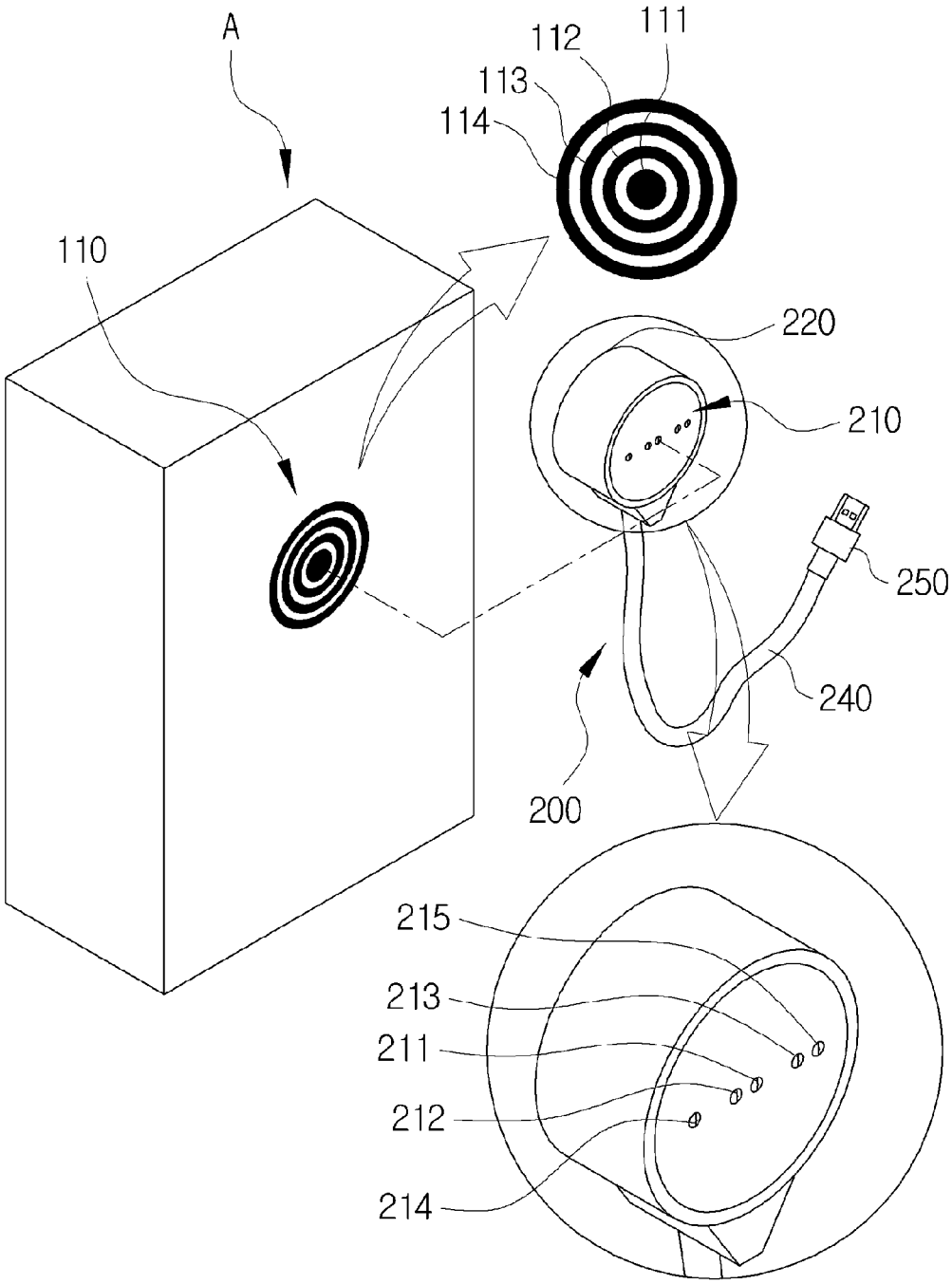
FIG. 1 is a perspective view of an electronic device including a magnetic connector module according to an exemplary embodiment of the present invention.
Figure 2:
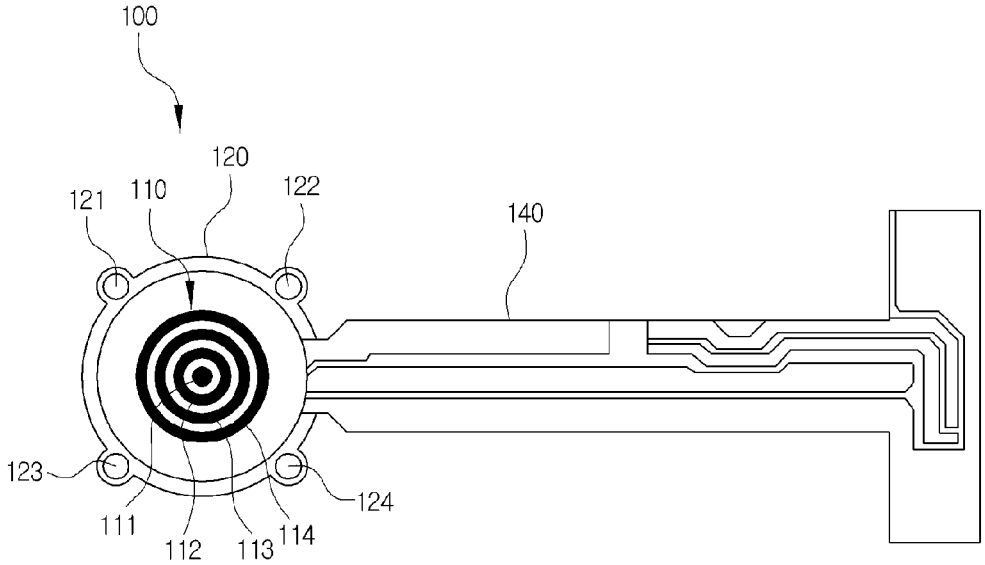
FIG. 2 is a plan view of a pattern electrode part module according to the exemplary embodiment of the present invention.
Figure 3:
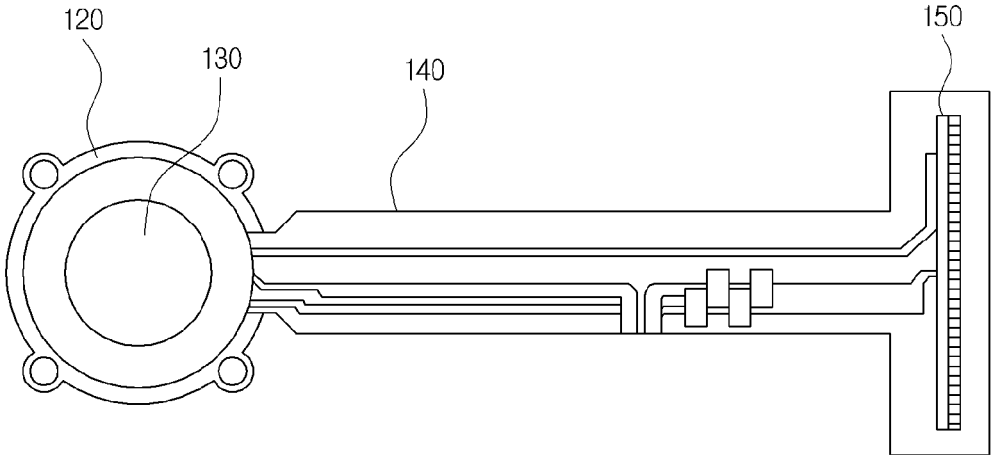
FIG. 3 is a bottom view of the pattern electrode part module according to the exemplary embodiment of the present invention.
Figure 4:
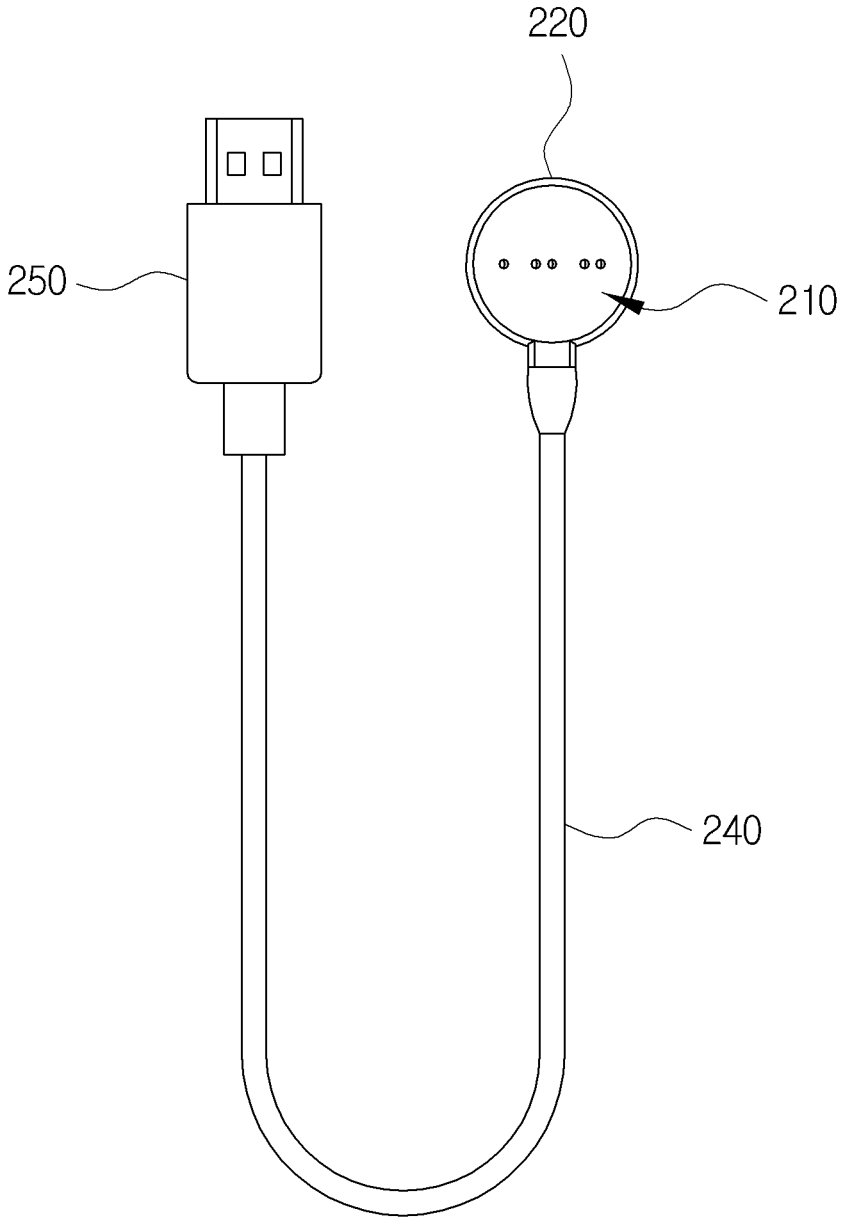
FIG. 4 is a plan view of a pin terminal part module according to the exemplary embodiment of the present invention.

FIG. 1 is a perspective view of an electronic device including a magnetic connector module according to an exemplary embodiment of the present invention; FIG. 2 is a plan view of a pattern electrode part module according to the exemplary embodiment of the present invention; and FIG. 3 is a bottom view of the pattern electrode part module according to the exemplary embodiment of the present invention; and FIG. 4 is a plan view of a pin terminal part module according to the exemplary embodiment of the present invention.

An electronic device A is installed with a pattern electrode part module 100 including pattern electrodes 110 having a concentric circle shape and receives power from a pin terminal part module 200 connected to a charging apparatus (not shown).

The magnetic connector module includes the pattern electrode part module 100 and the pin terminal part module 200.

The pattern electrode part module 100 includes the pattern electrode 110 in which electrodes 111 to 114 having a concentric circle shape are formed, a pattern electrode part body 120, a pattern electrode part magnet 130, a flexible printed circuit board (FPCB) 140 on which wires are formed, and a pattern electrode part connector 150.

The pattern electrode part body 120 includes the pattern electrode 110 formed on an upper surface thereof and the pattern electrode part magnet 130 formed at a lower surface thereof.

The electrodes of the pattern electrode 110 may be connected to the pattern electrode part connector 150 by the wires disposed on the FPCB 140, and the pattern electrode part connector 150 may be connected to a connector (not shown) disposed in the electronic device.

Although the pattern electrode part module 100 includes the FPCB 140 in the present embodiment, since the pattern electrode part connector 150 may also be installed in the pattern electrode part body 120, the FPCB 140 may be omitted.

The pattern electrode part body 120 may be provided with a plurality of fixing holes 121 to 124 and be fixed to the electronic device A in a scheme of inserting screws into the fixing holes 121 to 124. Since the pattern electrode part body 120 may also be fixed to the electronic device A in another scheme, the plurality of fixing holes 121 to 124 may also be omitted.

The pin terminal part module 200 includes a pin terminal part 210 in which a plurality of pin terminals 211 to 215 are formed, a pin terminal body part 220, a pin terminal cable 240, and a pin terminal part connector 250.

The pin terminal body part 220 includes the pin terminal part 210 formed on one surface thereof, wherein the pin terminal part 210 includes the plurality of pin terminals 211 to 215. In addition, the pin terminal part 210 includes a pin terminal part magnet (not shown) installed at an inner side thereof.

The plurality of pin terminals 211 to 215 of the pin terminal part 210 may be connected to the pin terminal part connector 250 through the pin terminal cable 240, and the pin terminal part connector 250 may be connected to a connector (not shown) of the charging apparatus.

The pin terminal part connector 250 may be formed of a universal serial bus (USB) connector. When the pin terminal part connector 250 is formed of the USB connector, there is an advantage that the pin terminal part connector 250 may be connected to various apparatuses in which an USB connector is installed.

The pin terminal part connector 250 may be implemented by various kinds of connectors in addition to the USB connector.

When the pattern electrode 110 and the pin terminal part 210 become close to each other, attractive force acts between the pattern electrode part magnet 130 and the pin terminal part magnet (not shown), and the electrodes 111 to 114 of the pattern electrode 110 contact the pin terminals 211 to 215 of the pin terminal part 210 by the attractive force. More specifically, the electrode 111 contacts the pin terminal 211, the electrode 112 contacts the pin terminal 212, the electrode 113 contacts the pin terminal 213, and the electrode 114 contacts the pin terminals 214 and 215. The pin terminal part 210 has a form in which the respective pin terminals 211 to 215 are exposed to five holes formed in a surface of the pin terminal part 210.

In the case in which the respective electrodes contact the respective pin terminals to thereby be electrically connected to the respective pin terminals, it is preferable that the pin terminals have an elastic structure in which they are pushed when they are pressed and spring by elasticity when force pressing them is removed. The reason is that all electrodes may contact the pin terminals corresponding thereto only when the pin terminals have the elastic structure.

When a structure of using a cylindrical pin terminal and a coil type spring is used in order to allow the pin terminal to have the elastic structure, the pin terminal part becomes thick, which is disadvantageous in miniaturizing the apparatus.

Therefore, it is preferable that the pin terminal is implemented by a leaf spring, or the like.

Figure 5:
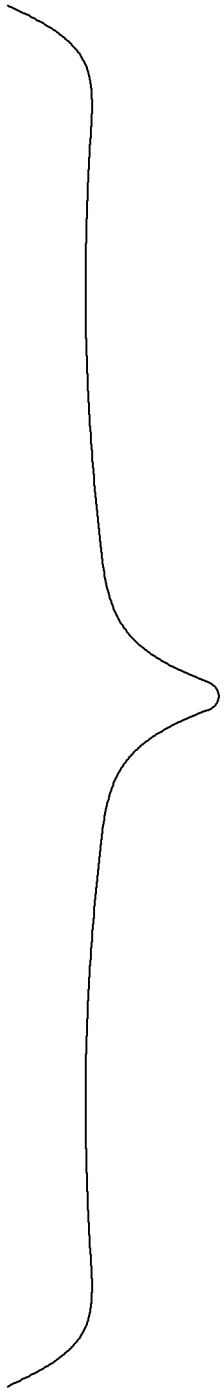
FIG. 5 is a side view of a leaf spring according to the exemplary embodiment of the present invention.

FIG. 5 is a side view of a leaf spring according to the exemplary embodiment of the present invention. When a thin and long rectangle material is bent to have a shape of the side view as shown in FIG. 5 and a protruded central portion is then exposed to a hole of the pin terminal part 210, the pin terminal part may be implemented in a very thin elastic structure.

When a width of the leaf spring is significantly decreased in a state in which the side view of the leaf spring is maintained as shown in FIG. 5, the leaf spring becomes a linear spring. That is, the leaf spring is manufactured by bending a metal wire in the shape of the side view as shown in FIG. 5.

When the linear spring is used in implementing the elastic structure, it is advantageous in decreasing weight of the pin terminal part and miniaturizing the pin terminal part.

In order for attractive force to act between the pattern electrode part magnet 130 and the pin terminal part magnet (not shown), magnets facing each other should have polarities opposite to each other.

Figure 6:
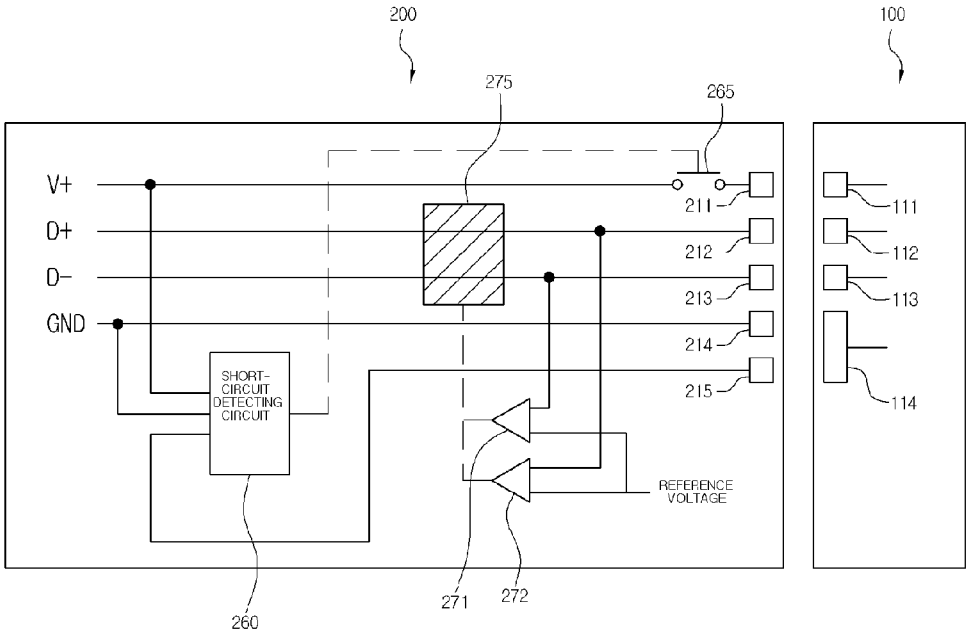
FIG. 6 is an internal circuit diagram of the magnetic connector module according to the exemplary embodiment of the present invention.

FIG. 6 is an internal circuit diagram of the magnetic connector module according to the exemplary embodiment of the present invention. The pin terminal 211 and the pin terminal 214 correspond to a power terminal VCC and a power terminal GND (ground electrode) for supplying power, respectively. The pin terminal 212 and the pin terminal 213 are a data terminal D+ and a data terminal D− for transferring data, respectively. The pin terminal 215 is a signal terminal S for detecting an electrical short-circuit.

When the pattern electrode part module 100 and the pin terminal part module 200 are coupled to each other, the pin terminals 211 to 214 contact the pattern electrodes 111 to 114, respectively, and the pin terminal 215 contacts the pattern electrode 114.

Therefore, when the pattern electrode part module 100 and the pin terminal part module 200 are stably coupled to each other, the pin terminal 214 and the pin terminal 215 are short-circuited.

When the pin terminal 214 and the pin terminal 215 are short-circuited, a short-circuit detecting circuit 260 detects that the pin terminal 214 and the pin terminal 215 are short-circuited to allow a switch 265 to be in a turn-on state. When the switch 265 is in the turn-on state, the power may be supplied to the pin terminal 211.

When the pin terminal 214 and the pin terminal 215 do not contact the pattern electrode 114, the switch 265 is in a turn-off state, such that the power supply to the pin terminal 211 is stopped.

The short-circuit detecting circuit 260 and the switch 265 configure a power supply blocking circuit. The power supply blocking circuit may be implemented by several methods, for example, a circuit shown in FIG. 7.

Figure 7:
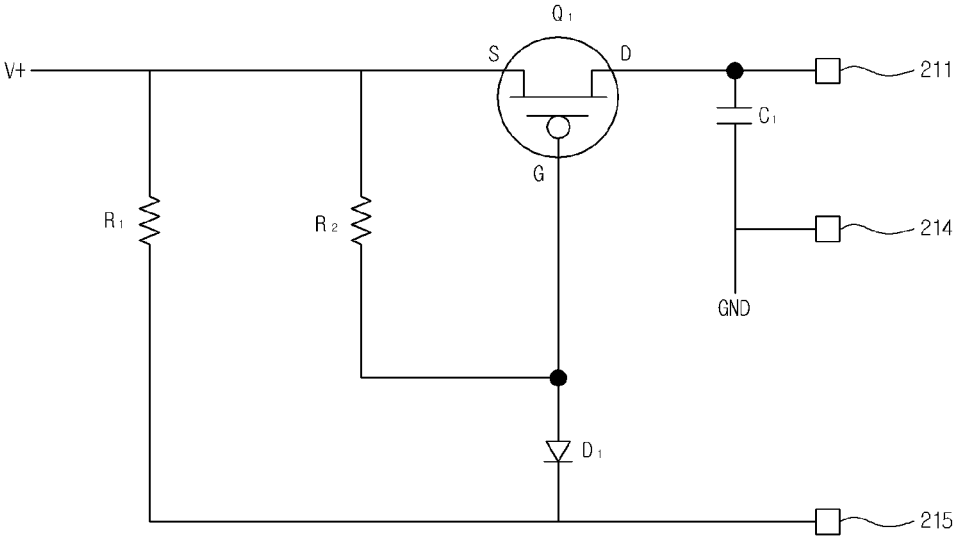
FIG. 7 is a detailed circuit diagram of a power supply blocking circuit according to the exemplary embodiment of the present invention.

FIG. 7 is a detailed circuit diagram of a power supply blocking circuit according to the exemplary embodiment of the present invention.

In the case in which the pin terminal 214 and the pin terminal 215 are not short-circuited, since a voltage of the pin terminal 215 becomes equal to that of a power supply line V+, the pin terminal 215 becomes a high state. Therefore, Q1 (P-channel metal oxide semiconductor field effect transistor: PMOSFET) is turned off, such that the power is not supplied to the pin terminal 211.

However, when the pin terminal 214 and the pin terminal 215 are short-circuited, the pin terminal 215 becomes a low state. Therefore, Q1 is turned on, such that the power of the power supply line V+ is supplied to the pin terminal 211.

When the pin terminal 214 and the pin terminal 215 are disconnected from each other in a state in which the power is supplied, since a voltage of the pin terminal 215 becomes equal to that of the power supply line V+, the power is not supplied to the pin terminal 211.

Due to the short-circuit detecting circuit 260 and the switch 265, when the pin terminal 214 and the pin terminal 215 contact the pattern electrode 114, the power starts to be supplied. Therefore, since the power starts to be supplied after the pattern electrodes 111 to 114 and the pin terminals 211 to 215 contact each other at accurate positions, even though a state in which a connection is erroneous instantaneously occurs, the power supply is instantaneously restricted, such that damage or a malfunction of a device does not occur.

The power supply blocking circuit may be installed in the pin terminal body part 220 or be installed in the pin terminal part connector 250.

Sometimes, the case in which a high voltage of the pin terminal 211 is introduced into the pin terminal 212 and the pin terminal 213 occurs. In this case, in order to prevent a malfunction and damage, a connection of a data line (signal line) to the pin terminal 212 and the pin terminal 213 needs to be stopped. More specifically, voltages of the pin terminal 212 and the pin terminal 213 do not exceed 3.3V in the case of USB communication. When the voltages of the pin terminal 212 and the pin terminal 213 exceed a reference voltage (for example, 3.7V), the connection of the data line is separated to prevent an abnormal voltage from being transferred to a digital circuit for the USB communication of a device having an abnormal device. In the case of data communication other than the USB communication, since a range of the voltage is changed, a reference voltage may be changed.

Operational amplifiers 271 and 272 of FIG. 6 turn off a switch 275 when the voltages of the pin terminal 212 and the pin terminal 213 are the reference voltage or more, thereby stopping data outputs to the pin terminal 212 and the pin terminal 213. In this case, the stopping of the data output may be implemented in a scheme of turning off both of the data outputs to the pin terminal 212 and the pin terminal 213 when the voltage of the pin terminal 212 or the voltage of the pin terminal 213 is the reference voltage or more, be implemented in a scheme of turning off the data output to the pin terminal 212 when the voltage of the pin terminal 212 is the reference voltage or more, and be implemented in a scheme of turning off the data output to the pin terminal 213 when the voltage of the pin terminal 213 is the reference voltage or more.

Since a process of turning on or turning off the switch according to an output value of the operational amplifier may be easily implemented by those skilled in the art as needed, a detailed description thereof will be omitted. In addition, the operational amplifier may be replaced by a comparator capable of performing the same function as that of the operational amplifier.

In the case in which the voltages of the pin terminal 212 and the pin terminal 213 are abnormally high, a circuit stopping the data outputs to the pin terminal 212 and the pin terminal 213 may be installed in the pin terminal body part 220 or be installed in the pin terminal part connector 250.

The pattern electrode part magnet and the pin terminal part magnet may be implemented in one pair or be implemented in several pairs.

Figure 8:
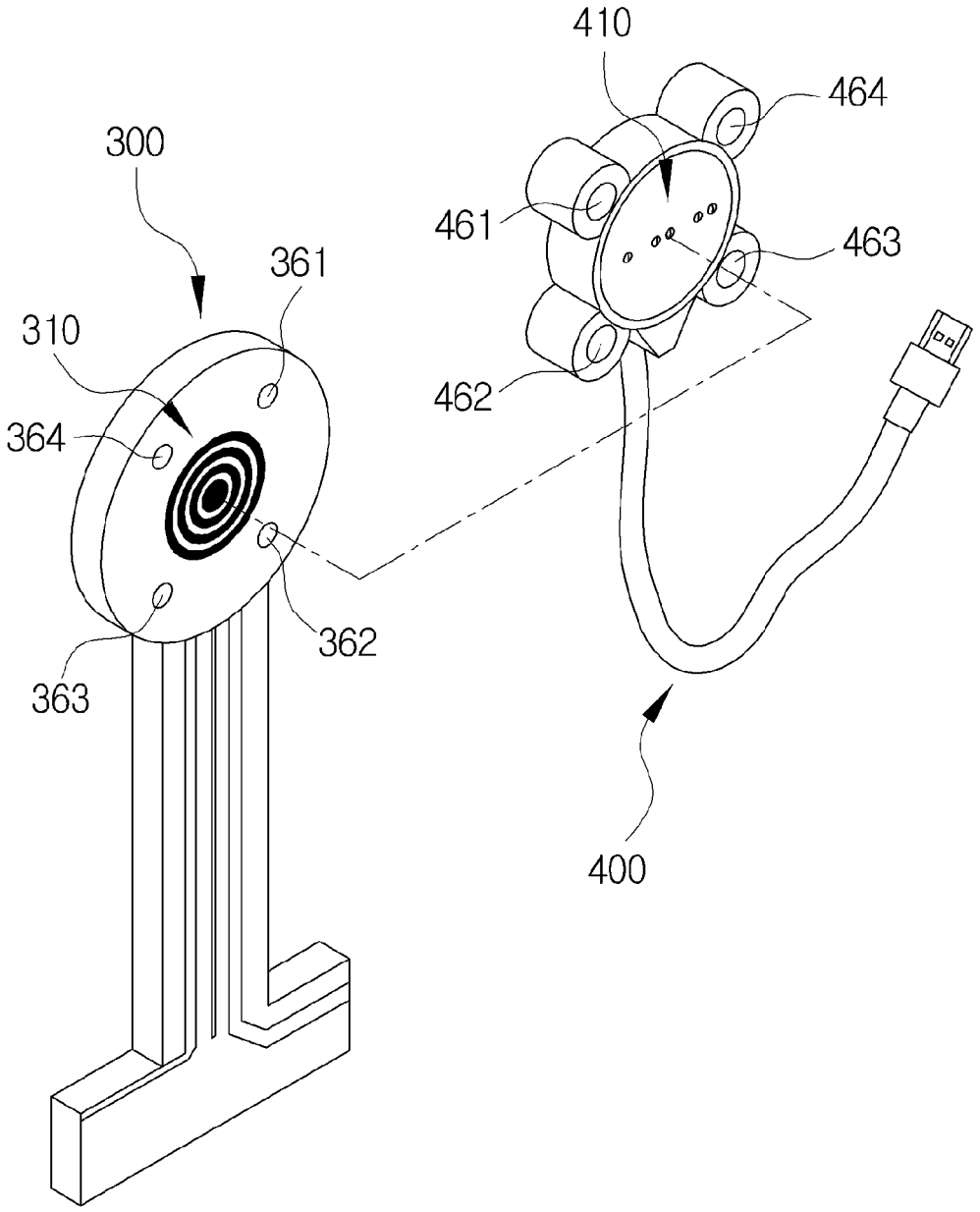
FIG. 8 is a perspective view of a magnetic connector module according to another exemplary embodiment of the present invention.

FIG. 8 is a perspective view of a magnetic connector module according to another exemplary embodiment of the present invention.

The magnetic connector module of FIG. 8 includes a pattern electrode part module 300 and a pin terminal part module 400. The pattern electrode part module 300 includes a pattern electrode 310 having a concentric circle shape, a first magnet (not shown) installed at an inner side of the pattern electrode 310, and four third magnets 361 to 364. The pin terminal part module 400 includes a pin terminal part 410, a second magnet (not shown) installed at an inner side of the pin terminal part 410, and four fourth magnets 461 to 464.

The first magnet is magnetically coupled to the second magnet, and the third magnets 361 to 364 are magnetically coupled to the fourth magnets 461 to 464, respectively, to allow the electrodes of the pattern electrode 310 to contact the pin terminals of the pin terminal part 410, thereby electrically connecting the electrodes of the pattern electrode 110 and the pin terminals to each other, respectively. In order for the first magnet and the second magnet to be magnetically coupled to each other and in order for the third magnets 361 to 364 and the fourth magnets 461 to 464 to be magnetically coupled to each other, respectively, the magnets facing each other should have polarities opposite to each other.

Here, since the third magnets 361 to 364 are disposed at intervals of the same angle at the same distance from the center of the pattern electrode in the vicinity of the pattern electrode and the fourth magnets 461 to 464 are disposed at intervals of the same angle at the same distance from the center of the pin terminal in the vicinity of the pin terminal, it is possible to rotate the pattern electrode part module 300 to attach the pattern electrode part module 300 to the pin terminal part module 400.

In order to couple the pattern electrode part module 100 or 300 the pin terminal part module 200 or 400 to each other using magnetic force, at least one pair of magnets is required. The magnets may be exposed on a surface of a product as in the third magnets 361 to 364 and the fourth magnets 461 to 464 of FIG. 8 or be embedded inside the product as in the first magnet and the second magnet.

Although the pattern electrodes 110 and 310 are implemented by four concentric circles in FIGS. 1 and 8, they may be implemented by two concentric circles except for electrodes for transmitting data or be implemented by more concentric circles by adding electrodes for another purpose. That is, the pattern electrodes may be implemented by two or more concentric circles.

In the exemplary embodiment shown in FIGS. 1 and 8, since the pattern electrode part module is installed in the electronic device and the pin terminal part module is connected to the charging apparatus, the power supply blocking circuit is installed in the pin terminal part module. However, when the pin terminal part module is installed in the electronic device and the pattern electrode part module is connected to the charging apparatus, the power supply blocking circuit may also be installed in the pattern electrode part module.

With the magnetic connector module having a power supply blocking circuit according to the exemplary embodiment of the present invention, even though a state in which a connection is erroneous before the connection is stabilized when a magnetic connector is connected instantaneously occurs, power supply is instantaneously restricted and a connection of a data line is blocked, such that damage or a malfunction of a device does not occur.

What is claimed is:

1. A magnetic connector module including a power supply blocking circuit, comprising:

a pattern electrode part module; and a pin terminal part module, wherein the pattern electrode part module includes pattern electrodes having a concentric circle shape, pattern electrode part magnets, and a pattern electrode part connector, wherein the pin terminal part module includes a plurality of pin terminals, pin terminal part magnets, and a pin terminal part connector, wherein the pattern electrode part magnets and the pin terminal part magnets are magnetically coupled to each other to allow the pattern electrodes and the plurality of pin terminals to contact each other, wherein the plurality of pin terminals include a power terminal VCC, a ground power terminal GND, and a signal terminal S, wherein an electrode contacting the ground power terminal GND and an electrode contacting the signal terminal S among the pattern electrodes are electrically short-circuited, and wherein the pin terminal part module includes the power supply blocking circuit allowing power supply to the power terminal VCC only in a state in which the ground power terminal GND and the signal terminal S are electrically short-circuited.

2. The magnetic connector module including a power supply blocking circuit of claim 1, wherein the plurality of pin terminals further include a data terminal D+ and a data terminal D−.

3. The magnetic connector module including a power supply blocking circuit of claim 2, wherein the pin terminal part module further includes a circuit stopping data outputs to the data terminal D+ and the data terminal D− in the case in which a voltage of the data terminal D+ or the data terminal D− is a predetermined reference voltage or more.

4. The magnetic connector module including a power supply blocking circuit of claim 2, wherein the pin terminal part module further includes a circuit stopping a data output to the data terminal D+ in the case in which a voltage of the data terminal D+ is a predetermined reference voltage or more and stopping a data output to the data terminal D− in the case in which a voltage of the data terminal D− is a predetermined reference voltage or more.

5. The magnetic connector module including a power supply blocking circuit of claim 1, wherein the electrode contacting the ground power terminal GND and the electrode contacting the signal terminal S among the pattern electrodes are formed integrally with each other and have a ring shape.

6. The magnetic connector module including a power supply blocking circuit of claim 1, wherein the pattern electrode part magnet is embedded inside the pattern electrode, and the pin terminal part magnet is embedded inside the pin terminal.

7. The magnetic connector module including a power supply blocking circuit of claim 1, wherein the pattern electrode part magnets are disposed at intervals of the same angle at the same distance from the center of the pattern electrode in the vicinity of the pattern electrode, and the pin terminal part magnets are disposed at intervals of the same angle at the same distance from the center of the pin terminal in the vicinity of the pin terminal.

8. The magnetic connector module including a power supply blocking circuit of claim 1, wherein the pattern electrode part magnets include a first magnet embedded inside the pattern electrode and third magnets disposed at intervals of the same angle at the same distance from the center of the pattern electrode in the vicinity of the pattern electrode, the pin terminal part magnets include a second magnet embedded inside the pin terminal and fourth magnets disposed at intervals of the same angle at the same distance from the center of the pin terminal in the vicinity of the pin terminal, and the first magnet is magnetically coupled to the second magnet and the third magnets are magnetically coupled to the fourth magnets, respectively, thereby electrically connecting the pattern electrodes and the plurality of pin terminals to each other, respectively.

9. The magnetic connector module including a power supply blocking circuit of claim 1, wherein the pin terminal part connector is a universal serial bus (USB) connector.

10. A magnetic connector module including a power supply blocking circuit, comprising:

a pattern electrode part module; and a pin terminal part module, wherein the pattern electrode part module includes pattern electrodes having a concentric circle shape, pattern electrode part magnets, and a pattern electrode part connector, wherein the pin terminal part module includes a plurality of pin terminals, pin terminal part magnets, and a pin terminal part connector, wherein the pattern electrode part magnets and the pin terminal part magnets are magnetically coupled to each other to allow the pattern electrodes and the plurality of pin terminals to contact each other, wherein the plurality of pin terminals include a power terminal VCC, a ground power terminal GND, and a signal terminal S, and wherein the pin terminal part module includes the power supply blocking circuit allowing power supply to the power terminal VCC only when the ground power terminal GND and the signal terminal S accurately contact electrodes corresponding thereto.

* * * * *